US011466825B2

(12) United States Patent
Siegel et al.

(10) Patent No.: US 11,466,825 B2
(45) Date of Patent: Oct. 11, 2022

(54) RECESSED LUMINAIRE WITHOUT AN INTEGRATED LIGHT SOURCE

(71) Applicant: SIGNIFY HOLDING B.V., Eindhoven (NL)

(72) Inventors: B. Glenn Siegel, Peachtree City, GA (US); Jyoti Kumar, Tyrone, GA (US); Jared Davis, Peachtree City, GA (US)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/022,614

(22) Filed: Sep. 16, 2020

(65) Prior Publication Data

US 2021/0231273 A1 Jul. 29, 2021

Related U.S. Application Data

(60) Provisional application No. 62/965,090, filed on Jan. 23, 2020.

(51) Int. Cl.

| | |
|---|---|
| ***F21S 8/02*** | (2006.01) |
| ***F21V 21/03*** | (2006.01) |
| ***F21V 23/06*** | (2006.01) |

(52) U.S. Cl.

CPC ..... *F21S 8/026* (2013.01); *F21V 21/03* (2013.01); *F21V 23/06* (2013.01)

(58) Field of Classification Search

CPC ..... F21S 8/026; F21V 21/03; F21V 23/06

See application file for complete search history.

(56) References Cited

U.S. PATENT DOCUMENTS

| | | | | | |
|---|---|---|---|---|---|
| 4,751,623 | A * | 6/1988 | Gaines | F21S 8/035 | 315/74 |
| 4,835,667 | A * | 5/1989 | Wolfe | F21V 25/10 | 362/276 |
| 4,947,297 | A * | 8/1990 | Druffel | F21V 19/04 | 362/147 |
| 5,073,845 | A * | 12/1991 | Aubrey | F21S 8/026 | 362/650 |
| 5,738,436 | A * | 4/1998 | Cummings | F21S 2/00 | 362/294 |
| 6,157,135 | A * | 12/2000 | Xu | F21V 25/10 | 315/104 |
| 6,217,199 | B1 * | 4/2001 | Lo | F21S 6/007 | 362/276 |
| 6,350,047 | B1 | 2/2002 | Ng et al. | | |
| 9,970,634 | B1 * | 5/2018 | Wronski | F21V 23/026 | |

(Continued)

FOREIGN PATENT DOCUMENTS

| | | |
|---|---|---|
| CN | 204005852 U | 12/2014 |
| CN | 206330004 U | 7/2017 |

(Continued)

*Primary Examiner* — Bryon T Gyllstrom
*Assistant Examiner* — Christopher E Dunay

(57) ABSTRACT

A recessed luminaire includes a trim, a junction box, and a light source socket. The trim includes a trim body, a flange, and a cover section. The flange extends out from the trim body at an opening of the trim. The junction box and the light source socket are attached to the trim. The light source socket is positioned inside a cavity of the trim. The light source socket may be attached to a cover section of the trim or to a bracket that is attached to the trim.

20 Claims, 17 Drawing Sheets

(56) References Cited

U.S. PATENT DOCUMENTS

| | | | | |
|---|---|---|---|---|
| 2003/0095413 | A1 | 5/2003 | Jamison | |
| 2006/0109660 | A1* | 5/2006 | Wolf | F21V 23/026 362/365 |
| 2009/0284958 | A1 | 11/2009 | Pickard et al. | |
| 2014/0003039 | A1 | 1/2014 | Steadman et al. | |
| 2015/0233537 | A1* | 8/2015 | Athalye | F21V 7/041 362/147 |
| 2015/0276141 | A1 | 10/2015 | White et al. | |
| 2016/0238226 | A1* | 8/2016 | Rashidi Doust | F21S 8/026 |
| 2018/0142871 | A1* | 5/2018 | Morales | F21V 21/14 |
| 2020/0363025 | A1 | 11/2020 | Jeswani et al. | |

FOREIGN PATENT DOCUMENTS

| | | | |
|---|---|---|---|
| CN | 109812742 | A | 5/2019 |
| GB | 2490956 | A | 11/2012 |

* cited by examiner

RECESSED LUMINAIRE WITHOUT AN INTEGRATED LIGHT SOURCE

CROSS REFERENCE TO RELATED APPLICATIONS

The present application claims priority under 35 U.S.C. Section 119(e) to U.S. Provisional Patent Application No. 62/965,090, filed Jan. 23, 2020 and titled "Recessed Luminaire Without An Integrated Light Source," the entire content of which is incorporated herein by reference.

TECHNICAL FIELD

The present disclosure relates generally to lighting-related solutions, and more particularly to recessed can-less luminaires.

BACKGROUND

A recessed luminaire typically includes a luminaire housing, a light module, and one or more trim components. For example, the housing is retained behind a ceiling using one or more retaining structures, and the light module is positioned inside the housing. The light module typically needs to be retained inside the housing using one or more retaining components. In addition, one or more trim components need to be attached to the housing and/or the light module. Thus, in some cases, the number of components of such luminaires may result in increased product cost as well as longer installation time. In addition, the light source of the light module is often fixedly attached, requiring the replacement of the entire light module in order to change the light source. Thus, a solution that reduces the number of major components of recessed luminaires and that enables changeability of the light source of such luminaires is desirable.

SUMMARY

The present disclosure relates generally to lighting-related solutions, and more particularly to recessed can-less luminaires. In some example embodiments, a recessed luminaire includes a trim, a junction box, and a socket. The trim includes a trim body, a flange, and a cover section. The flange extends out from the trim body at an opening of the trim. The junction box and the socket are attached to the trim. The socket is positioned inside a cavity of the trim.

In another example embodiments, a recessed luminaire includes a trim, a junction box, and a socket. The recessed luminaire further includes a light source attached to the socket. The trim includes a trim body, a flange, and a cover section. The flange extends out from the trim body at an opening of the trim. The junction box and the socket are attached to the trim. The socket is positioned inside a cavity of the trim such that the light source emits a light through an opening of the trim.

In another example embodiments, a luminaire includes a trim that includes a body, a flange, and a light emitting opening. The luminaire further includes one or more retention devices coupled to an outer surface of the body of the trim. The luminaire also includes a lamp socket disposed on an inner surface of the body of the trim, and an aperture in the body of the trim. The luminaire further includes a conduit comprising a first end and a second end, the first end adapted to couple to the aperture in the body of the trim and the second end adapted to couple to a junction box.

These and other aspects, objects, features, and embodiments will be apparent from the following description and the claims.

BRIEF DESCRIPTION OF THE FIGURES

Reference will now be made to the accompanying drawings, which are not necessarily drawn to scale, and wherein.

Figure 1:
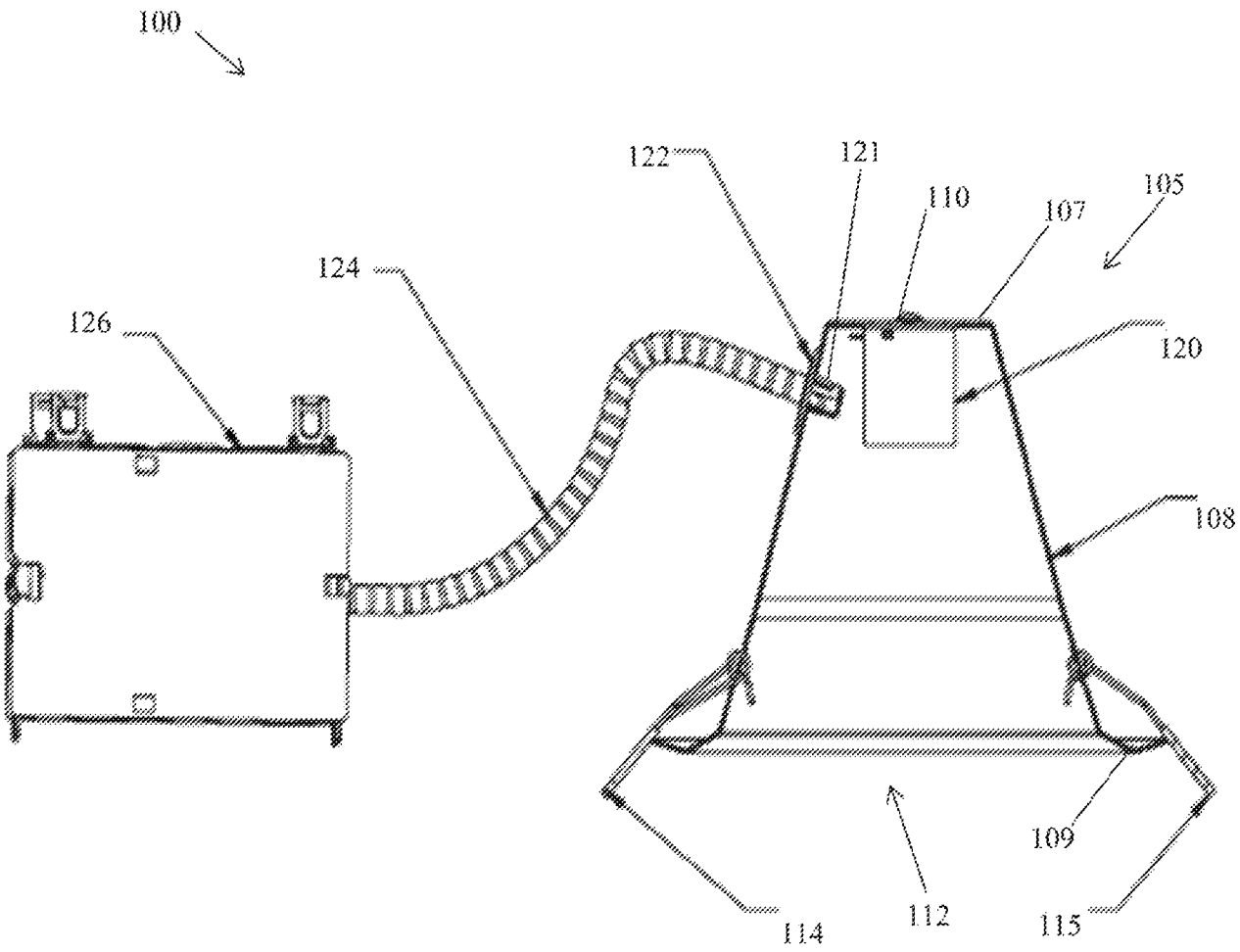
FIG. 1 illustrates a partial cross-sectional view of a recessed luminaire according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, the same reference numerals used in different drawings designate like or corresponding but not necessarily identical elements.

DETAILED DESCRIPTION OF EXAMPLE EMBODIMENTS

In the following paragraphs, example embodiments will be described in further detail with reference to the figures. In the description, well-known components, methods, and/or processing techniques are omitted or briefly described. Furthermore, reference to various feature(s) of the embodiments is not to suggest that all embodiments must include the referenced feature(s).

The example embodiments described herein relate to a recessed luminaire that can be directly mounted to a ceiling and that does not have an integrated light source. The recessed luminaires of the example embodiments described herein provide several advantages. As will be described further below, the example recessed luminaires require fewer components and have less complexity relative to prior art recessed luminaires. Additionally, the light source of the example recessed luminaires in the following description is not integrated. In other words, the light source of the following example recessed luminaires is a light source (e.g., a lamp) that can be attached or replaced by a customer, custodian, or other end user. As used herein, a light source is a separate unit that is held by a socket.

Figure 2:
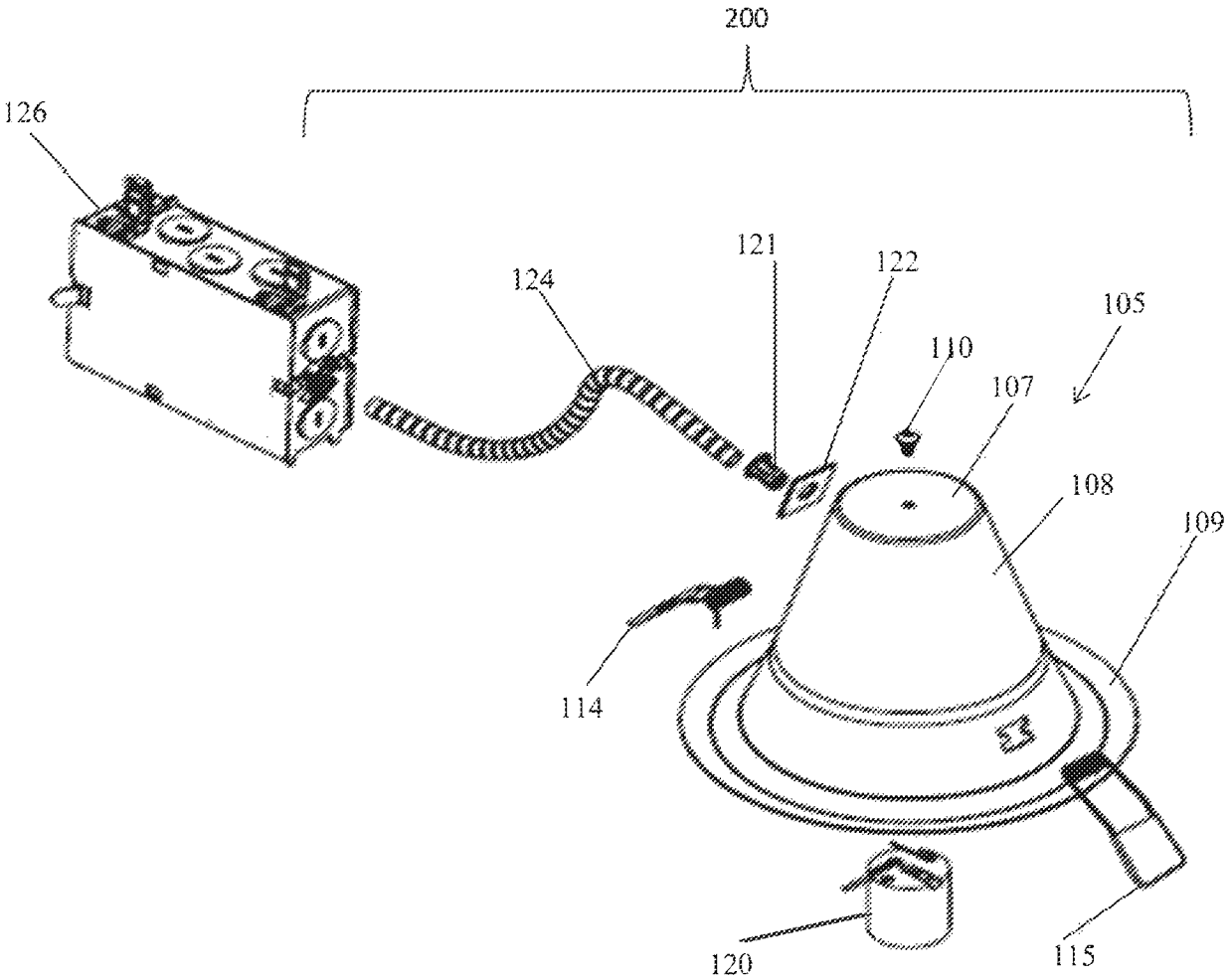
FIG. 2 illustrates a perspective exploded view of the recessed luminaire of FIG. 1 according to an example embodiment.

Referring now to FIGS. 1 and 2, a recessed luminaire 100 is illustrated in accordance with an example embodiment of the present disclosure. FIG. 1 provides a side elevational view of the recessed luminaire 100 with a trim 105 shown in cross-section so that interior features are visible. FIG. 2 provides a perspective exploded view of the recessed luminaire 100. The trim 105 comprises a trim top 107, a trim body 108, and a trim flange 109, wherein the trim 105 defines a cavity within the trim 105 and has a light emitting opening 112 adjacent to the trim flange 109. The example trim 105 shown in FIGS. 1 and 2 has a generally conical shape with the top truncated by the trim top 107, however, it should be appreciated that in alternate embodiments the trim can have other shapes including but not limited to cylindrical, pyramidal, and cuboid. The trim 105 of recessed luminaire 100 provides several advantages over prior art recessed luminaires in that the trim 105 integrates the function of several prior art components into a single continuous component. For example, the trim 105 can be molded or formed as a single continuous component from one or more of a variety of materials, including polycarbonate, other polymers, metals, or composites. The trim 105 can eliminate the need for separate housing, reflector, and trim components that would need to be attached mechanically. The trim 105 provides the functions of the housing and includes an integrated trim flange 109. Additionally, the inner surface of the trim 105 (or portions thereof) can serve the function of a reflector. In certain example embodiments, the inner surface of the trim 105 comprises a coating or features that reflect, diffuse, or otherwise modify light emitted by a light source from within the cavity of the trim 105.

While the trim 105 illustrated in FIGS. 1 and 2 is a single integrated and continuous component, it should be understood that this is not a requirement for certain of the other advantages provided by the recessed luminaire 100. In some alternative embodiments, the trim 105 may be a multi-component unit that includes two components, such as a trim cap and a trim base, that can be coupled or decoupled with threads, snaps, or another coupling mechanism as can be readily understood by those of ordinary skill in the art with the benefit of the scope of this disclosure. A trim that comprises multiple components can facilitate installation of the recessed luminaire in some example circumstances.

Attached to the trim body 108 are retention devices 114 and 115. In the example recessed luminaire 100, the retention devices 114 and 115 are mousetrap springs positioned to secure the trim 105 to a portion of the ceiling between the mousetrap springs and the trim flange 109. In other words, when the recessed luminaire 100 is inserted through an opening in a ceiling and into the plenum space above a ceiling, the trim flange 109 abuts against the lower side of the ceiling that is visible from the room below and the mousetrap springs 114 and 115 are biased to press against the opposite upper side of the ceiling. It should be understood that in alternate embodiments, retention devices other than mousetrap springs can be used to secure the recessed luminaire to the ceiling. Additionally, although the retention devices 114 and 115 are shown attached to the trim body 108, it should be understood that the retention devices can be secured to other portions of the luminaire 100 such as the trim flange 109 or to one or more flanges or rings (not shown) that extend from the outer surface of the trim body 108. In some example embodiments, the retention devices 114 and 115 may be attached to the trim body 108 using brackets as shown in FIG. 1. Alternatively, the retention devices 114 and 115 may be attached to the trim body 108 as can be readily understood by those of ordinary skill in the art with the benefit of the scope of this disclosure.

Within the cavity of the trim 105 is a light source socket (in this case, an Edison screw socket 120) attached to the inner surface of the trim top 107 by a fastener 110. The Edison screw socket 120 can receive any of a variety of light sources available that have a complementary base, such as an LED light source or a compact fluorescent light source, that are an improvement over incandescent light sources and that have an Edison screw base. Most A19/A60 light sources (also referred to as light bulbs) come with a one-inch long Edison screw base, either of type E26 (i.e. 26 millimeters in diameter) in countries with a mains voltage of 100-120 volts, or of type E27 (i.e. 27 millimeters in diameter) in countries with 220-240 volts AC. In another example embodiment, the Edison screw socket 120 can receive an adapter that has an Edison screw base on one end, a connector on the other end, and adapter wiring connecting the Edison screw base and the connector. The adapter can be used to connect a light module, such as an LED light module, to the trim 105. In such an example, the light module can be attached to the interior surface of the trim 105 with friction blades or other mechanisms and the light module can provide a retrofit solution.

It should be understood that the light source socket and light source base are not limited to the Edison screw arrangement. For example, in other embodiments, such as certain MR-16 light sources and compact fluorescent light sources, the light source base and the socket can have pins and complementary receptacles to receive the pins.

The luminaire wiring connects the Edison screw socket 120 to a junction box 126. In certain embodiments, the junction box 126 can be considered part of the luminaire 100. However, in other example embodiments, the junction box 126 can be omitted and wiring connections can be completed through other approaches. A first end of the luminaire wiring attaches to the Edison screw socket 120 and the luminaire wiring passes through an aperture in the trim body 108, through a conduit connector 121 disposed in the aperture in the trim body 108 and into a conduit 124. The conduit 124 can be sealed to the conduit connector 121 with a gasket 122. The luminaire wiring continues through the conduit 124 and can terminate in the junction box 126. Within the junction box 126, external wiring providing power from a power source can attach to the terminations of the luminaire wiring.

The combination of the Edison screw socket 120 with the continuous integrated body of the trim 105 provides several advantages over the prior art solutions. For example, the luminaire 100 provides a simpler and cost-effective lighting solution that is easier to manufacture and maintain. The luminaire 100 is also advantageous in that its fewer components make it easier to install. Furthermore, the example luminaire 100 provides flexibility in that a customer or end user can easily attach one of a variety of light sources to the luminaire 100 using the Edison screw socket 120. The easy attachment of the light source also allows the customer or end user to easily modify or upgrade the light source used in the luminaire 100.

Figure 3:
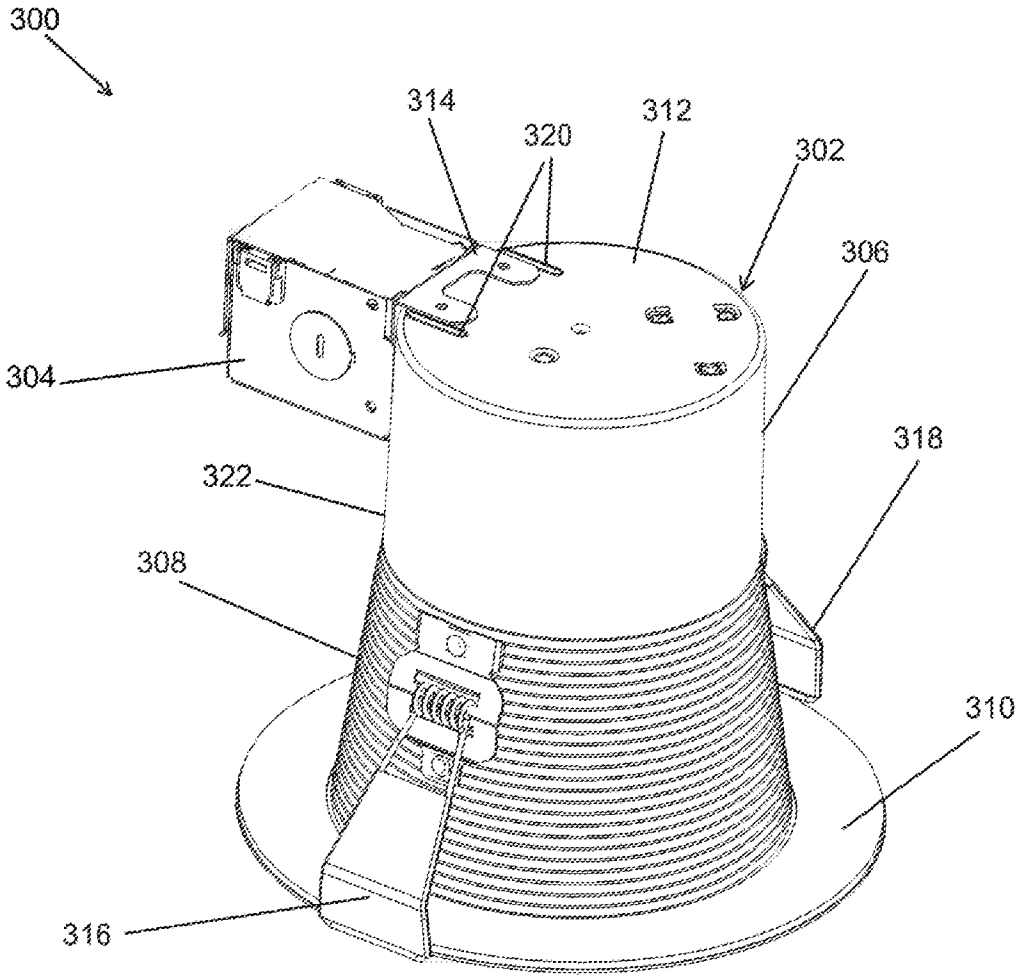
FIG. 3 illustrates a perspective view of a recessed luminaire according to an example embodiment.
Figure 4:
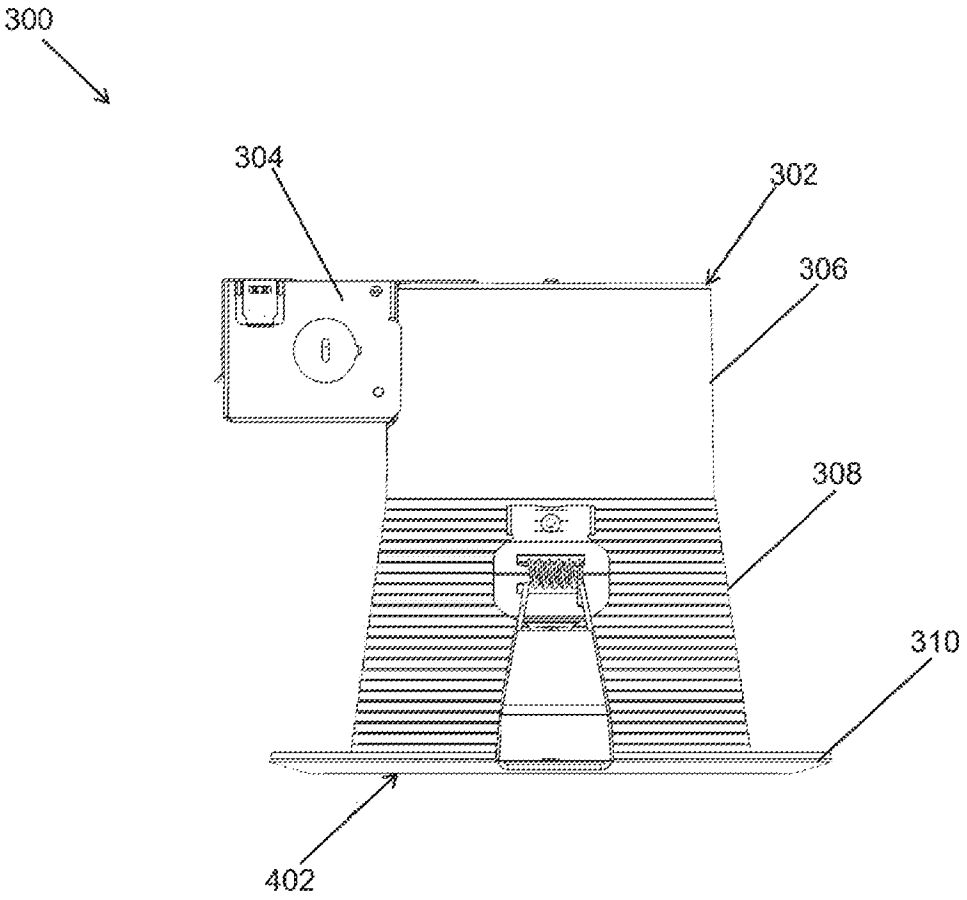
FIG. 4 illustrates a side view of the recessed luminaire of FIG. 3 according to an example embodiment.

FIG. 3 illustrates a perspective view of a recessed luminaire 300 according to an example embodiment, and FIG. 4 illustrates a side view of the recessed luminaire 300 of FIG. 3 according to an example embodiment. In some example embodiments, the luminaire 300 includes a trim 302 and a junction box 304. The junction box 304 may be attached to the trim 302. The trim 302 includes a trim body 306, a flange 310, and a cover section 312. For example, the trim cover 312 may correspond to the trim top 107 of the luminaire 100, the trim body 306 may correspond to the trim body 108 of the luminaire 100, and the flange 310 may correspond to the trim flange 109 of the luminaire 100. The trim body 306 and the cover section 312 define a cavity of the trim 302. The cover section 312 encloses the cavity of the trim 302 at an opposite end from an opening 402 of the trim 302. As described below, the luminaire 300 may include a light source socket that is disposed inside the cavity of the trim 302. The luminaire 300 may also include a light source that is attached to the light source socket.

In some example embodiments, the flange 310 extends out from the trim body 306 at the opening 402 of the trim 302. The trim body 306 may include a baffle section 308 and a cylindrical section 322. The baffle section 308 may be tapered as shown in FIG. 3. For example, the baffled section 308 may extend down outwardly from the cylindrical section 322. The flange 310 may extend outwardly from the baffle section 308 at the opening 402 of the trim 302. The luminaire 300 provides light, such as an illumination light, through the opening 402.

In some example embodiments, the cylindrical section 322 may serve as a reflector to direct light toward an area illuminated by the luminaire 300, and the baffle section 308 may serve as a baffle to minimize glare from the light source of the luminaire 300. In some example embodiments, the baffle section 308 may be patterned to minimize glare as can be readily understood by those of ordinary skill in the art. Alternatively, the baffle section 308 may not include a pattern. In some example embodiments, the baffle section 308 may serve as a reflector to direct light toward an area illuminated by the luminaire 300.

In some example embodiments, the junction box 304 may be attached to the cover section 312 of the trim 302 using one or more fasteners. For example, the junction box 304 may be directly attached to the trim 302. To illustrate, the junction box 304 may include an attachment tab 314 that extends from the main body of the junction box 304, and one or more fasteners may be used to securely attach the attachment tab 314 to the cover section 312. The attachment tab 314 may be positioned between guides 320 that are used to align the attachment tab 314 such that the junction box 304 is correctly attached to the trim 302.

In some example embodiments, the luminaire 300 may include retaining structures 316, 318 that are used to retain the luminaire 300 recessed in a ceiling. The retaining structures 316, 318 may be attached to the trim body 306 using fasteners. The retaining structures 316, 318 may be clamped down over a ceiling after the luminaire 300 is recessed through an opening in a ceiling. To illustrate, when the luminaire 300 is recessed in a ceiling through an opening in the ceiling, the flange 310 is below the ceiling, and the retaining structures 316, 318 are behind the ceiling and clamped down onto the ceiling. When the luminaire 300 is recessed in a ceiling, the flange 310 is in view from below the ceiling, for example, of a room, and the retaining structures 316, 318 are hidden from view from below the ceiling.

In some example embodiments, the luminaire 300 may include a gasket 324 that is positioned on the flange 310 around the trim body 306. The gasket 324 may serve to prevent or reduce air flow through a gap that may exist between the flange 310 and the ceiling. For example, the gasket 324 may prevent or reduce air flow between an area (e.g., an air conditioned area) below a ceiling and an area behind the ceiling. In some alternative embodiments, the gasket 324 may be omitted without departing from the scope of this disclosure.

In some example embodiments, the trim 302 may be made from aluminum and/or other suitable material as can be as can be readily understood by those of ordinary skill in the art. For example, the trim 302 may be made using methods such as spinning and/or other methods as can be readily understood by those of ordinary skill in the art. The trim 302 may be made as a single continuous unit. Alternatively, the trim 302 may include separate components that are attached to relevant using, for example, screws, clips, and/or welding, etc. to form the trim 302. The junction box 304 may be made from steel and/or other suitable material(s) using methods known to those of ordinary skill in the art with the benefit of this disclosure.

In some example embodiments, some portions of the entire trim 302 may be painted to have one or more desired colors. For example, the inside surfaces of the trim 302 or portions thereof may be painted or may otherwise be coated to achieve in light reflection, diffusion, or other effects. To illustrate, the inside surface of the baffle section 308 may also be painted white or another color. As another example, the surface of the flange 310 facing toward an area illuminated by the luminaire 300 may be painted, for example, white or another color.

In general, the luminaire 300 offers the same or similar benefits described above with respect to the luminaire 100. Because the luminaire 300 does not include a luminaire housing, the installation of the luminaire 300 is simplified compared to recessed luminaires that include a luminaire housing. To illustrate, the luminaire 300 avoids the need for retaining a separate luminaire housing behind a ceiling. The use of the trim 302 may avoid the need for additional trim components that may be used in some recessed luminaires and, thus, avoid the need for retaining trim components to a luminaire housing. Further, the trim 302 can eliminate the need for a separate baffle and/or a separate reflector. All of these benefits may result in reduced cost relative to some recessed luminaires. Further, the use of a light source socket enables a consumer to alter the lighting provided by the luminaire 300 by allowing the light source of the luminaire 300 to be changeable by the consumer.

In some alternative embodiments, the trim 302 or sections of the trim 302 (e.g., the flange 310) may have a different shape (e.g., a rectangular flange and/or trim body) than shown without departing from the scope of this disclosure. In some alternative embodiments, the junction box 304 may have a different shape than shown without departing from the scope of this disclosure. In some alternative embodiments, the junction box 304 may be attached to the trim 302 at a different location and/or using other means than shown without departing from the scope of this disclosure. For example, the junction box 304 may not be in direct contact with the trim 302, where a conduit and/or an arm may extend between the trim 302 and the junction box 304. In some alternative embodiments, the baffle section 308 may not be tapered without departing from the scope of this disclosure. In some example embodiments, the relative sizes of the baffle section 308 and the cylindrical section 322 may be different than shown without departing from the scope of this disclosure. In some alternative embodiments, the retaining structures 316, 318 may be attached to the trim 302 at different locations than shown without departing from the scope of this disclosure. In some example embodiments, the retaining structures 316, 318 may be attached to the trim 302 without using brackets as can be readily understood by those of ordinary skill in the art with the benefit of the scope of this disclosure. In some alternative embodiments, other types of retaining structures may be used to retain the luminaire 300 recessed behind a ceiling without departing from the scope of this disclosure. In some alternative embodiments, the luminaire 300 may include fewer components without departing from the scope of this disclosure. For example, the junction box 304 may be omitted without departing from the scope of this disclosure. In some alternative embodiments, the guides 320 may be omitted without departing from the scope of this disclosure.

Figure 5:
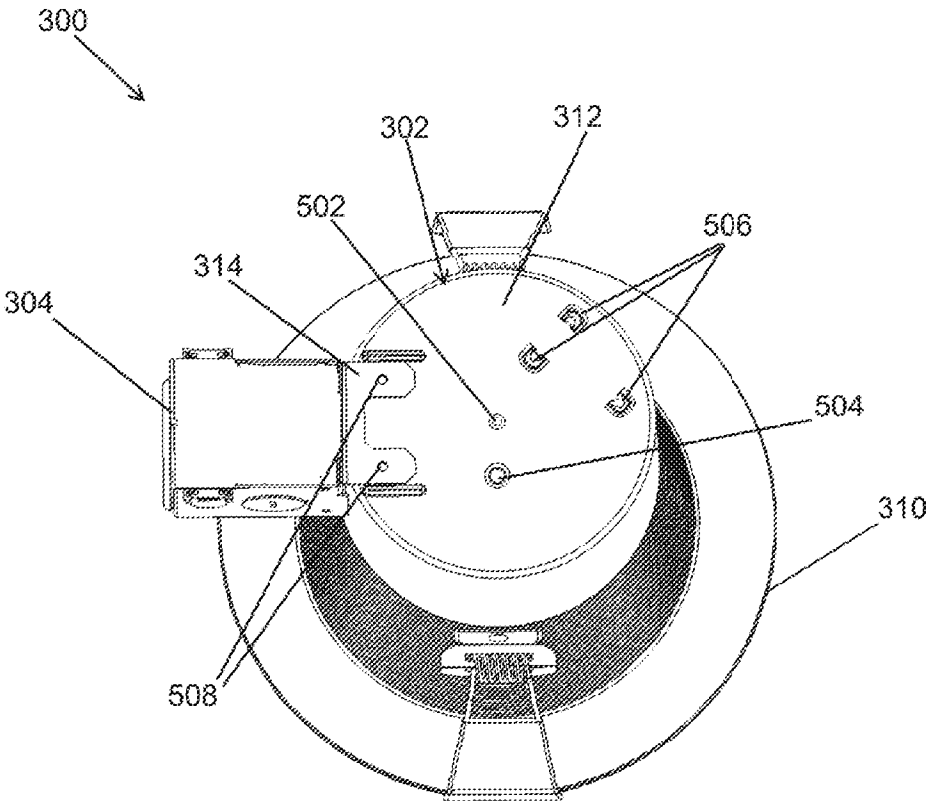
FIG. 5 illustrates a top perspective view of the recessed luminaire of FIG. 3 according to an example embodiment.

FIG. 5 illustrates a top perspective view of the recessed luminaire 300 of FIG. 3 according to an example embodiment. Referring to FIGS. 3-5, in some example embodiments, when the luminaire 300 is installed recessed in a ceiling, the flange 310 is positioned below the ceiling and the rest of the luminaire 300 primarily behind the ceiling, where a portion of the trim 302 extends through an opening in the ceiling as can be readily understood by those of ordinary skill in the art with the benefit of the scope of this disclosure. In some example embodiments, a light source socket may be positioned in a cavity of the trim 302 as described below, and a fastener 502 (e.g., a screw) may be used to attach a light source socket to the cover section 312 of the trim 302. For example, the fastener 502 may extend through a hole in the cover section 312 as can be readily understood by those of ordinary skill in the art with the benefit of the scope of this disclosure. The cover section 312 may include a locator indent 504 that may be used to retain the light source socket in position during and after attachment of the light source socket to the cover section 312. The indent 504 can also help prevent the light source socket from spinning when a light source (e.g., a light source with E26 base) is being attached to the socket.

Figure 7:
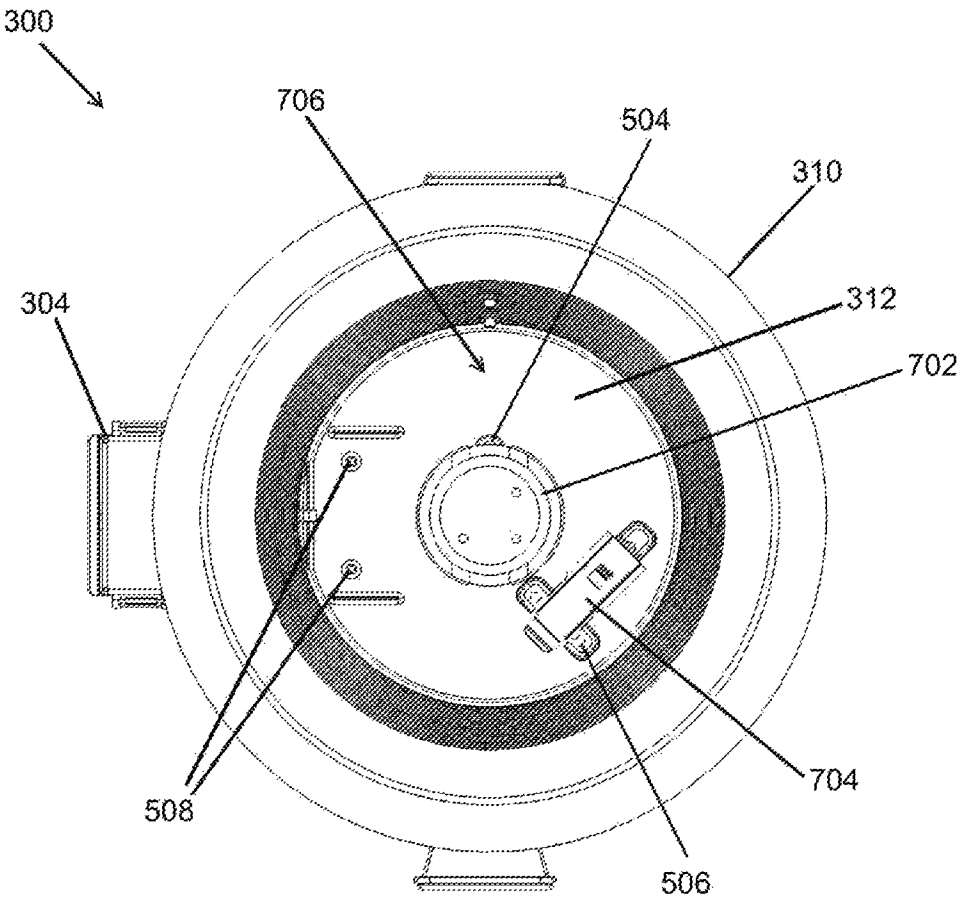
FIG. 7 illustrates a bottom view of the recessed luminaire of FIG. 3 according to an example embodiment.

In some example embodiments, the luminaire 300 may include a thermal protector positioned in the cavity of the trim 302, for example, as shown in FIG. 7. The cover section 312 may include indents 506 that are used to retain the thermal protector attached to the trim 302. The indents 506 may prevent air flows that might otherwise occur if, for example, screws extending through holes were used to attach the thermal protector to the cover section 312. The thermal protector serves to disconnect electrical power from the light source socket and a light source attached to the light source socket when the temperature in the cavity of the trim 302 exceeds a threshold temperature that may cause a fire.

In some example embodiments, fasteners 508 may be used to attach the junction box 304 to the trim 302. For example, the fasteners may extend through matching holes in the cover section 312 and the attachment tab 314 to attach the junction box 304 to the trim 302 as can be readily understood by those of ordinary skill in the art with the benefit of the scope of this disclosure.

In some alternative embodiments, the locator indent 504 may be omitted without departing from the scope of this disclosure. In some alternative embodiments, in addition or instead of the indents 506, other means (e.g., screw(s) may be used to retain the thermal protector without departing from the scope of this disclosure. In some alternative embodiments, in addition or instead of the fasteners 508, other means may be used to attach the junction box 304 to the cover section 312 without departing from the scope of this disclosure. In some alternative embodiments, the junction box 304 may be attached to another part of the trim 302 instead of or in addition to the cover section 312 without departing from the scope of this disclosure.

Figure 6:
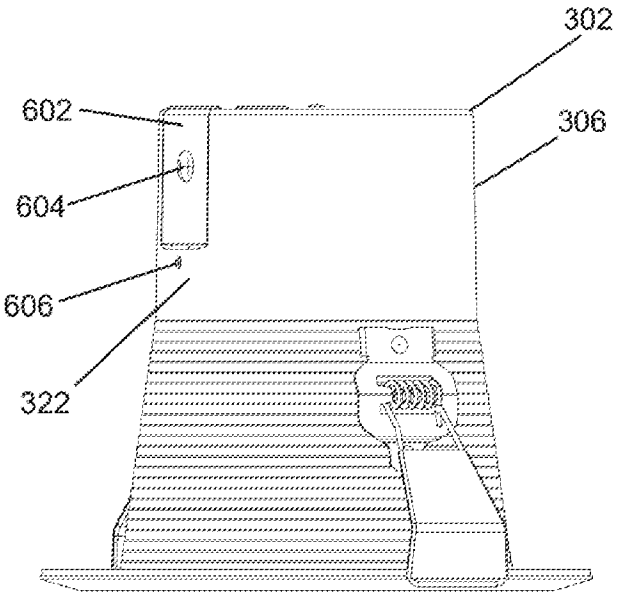
FIG. 6 illustrates a side perspective view of the recessed luminaire of FIG. 3 without a junction box according to an example embodiment.

FIG. 6 illustrates a side perspective view of the recessed luminaire 300 of FIG. 3 without the junction box 304 according to an example embodiment. Referring to FIGS. 3-6, in some example embodiments, the cylindrical section 322 of the trim body 306 may include a substantially flat section 602 that includes a wire opening 604. For example, a portion of a wall of the junction box 304 may come in direct contact with the flat section 602, and a wire opening of the junction box 304 may be aligned with the wire opening 604 for routing one or more electrical wires between the cavity of the trim 302 and the cavity of the junction box 304. In some example embodiments, a gasket may be used to cover the wire opening 604 while providing an opening for routing electrical wires therethrough as can be readily understood by those of ordinary skill in the art with the benefit of the scope of this disclosure.

In some example embodiments, the trim body 306 may include an attachment hole 606 that may be used to securely attach the junction box 304 to the trim 302. For example, the attachment hole 606 may be formed in the cylindrical section 322 of the trim body 306. A fastener that extends through the attachment hole 606 may be used to attach the junction box 304 to the trim 302 as more clearly shown, for example, in FIG. 8.

In some alternative embodiments, the attachment hole 606 may be at a different location than shown without departing from the scope of this disclosure. In some alternative embodiments, the attachment hole 606 may be omitted without departing from the scope of this disclosure.

FIG. 7 illustrates a bottom view of the recessed luminaire 300 of FIG. 3 according to an example embodiment. Referring to FIGS. 3-7, in some example embodiments, the flange 310 is positioned below a ceiling of an area and visible from below the ceiling when the luminaire 300 is installed. In some example embodiments, the luminaire 300 includes a light source socket 702 and a thermal protector 704 that are in a cavity 706 of the trim 302. The socket 702 may be attached to the cover section 312 by the fastener 502 that is more clearly shown in FIG. 5. For example, the socket 702 may be in direct contact with the cover section 312, which allows and facilitates heat transfer from the socket 702 to the trim 302. A heat shield material 810 or another type of material may be used between the socket 702 and the cover section 312. For example, the heat shield material 810 positioned between the socket 702 and the cover section 312 may prevent excessive transfer of heat from the socket 702 to the cover section 312. To illustrate, the heat shield material 810 may help the cover section 312 from heating up to over 90 degrees Celsius. In some example embodiments, the socket 702 may be made from a ceramic material. The locator indent 504 may retain the socket 702 in position, for example, by preventing the rotation of the socket 702. The indent 504 can also help prevent the light source socket 702 from spinning when a light source is being attached to the light source socket 702.

In some example embodiments, the thermal protector 704 may be attached to the cover section 312 by the indents 506. For example, the thermal protector 704 may include one or more brackets that mount the thermal protector 704 to the cover section 312 and enclose high voltage wires of the thermal protector 704. To illustrate, the one or more brackets of the thermal protector 704 may be attached to the indents 506 to attach the thermal protector 704 to the cover section 312. Alternatively, the one or more brackets of the thermal protector 704 may be attached to the cover section 312 or to another part of the trim 302 using other means, such as screws and/or clips, without departing from the scope of this disclosure. The thermal protector 704 may serve reduce the risk of fire by disconnecting electrical power from the light source socket 702 if the temperature in the cavity of the trim 302 exceeds a threshold temperature.

In some alternative embodiments, the thermal protector 704 may be attached to the cover section at a different location than shown without departing from the scope of this disclosure. In some example embodiments, the thermal protector 704 may be attached to another part of the trim 302, such as the trim body 306, without departing from the scope of this disclosure. In some alternative embodiments, the thermal protector 704 may be attached to the trim 302 using other means instead of or in addition to the indents 506 without departing from the scope of this disclosure. In some alternative embodiments, the heat shield material may be omitted without departing from the scope of this disclosure.

Figure 8:
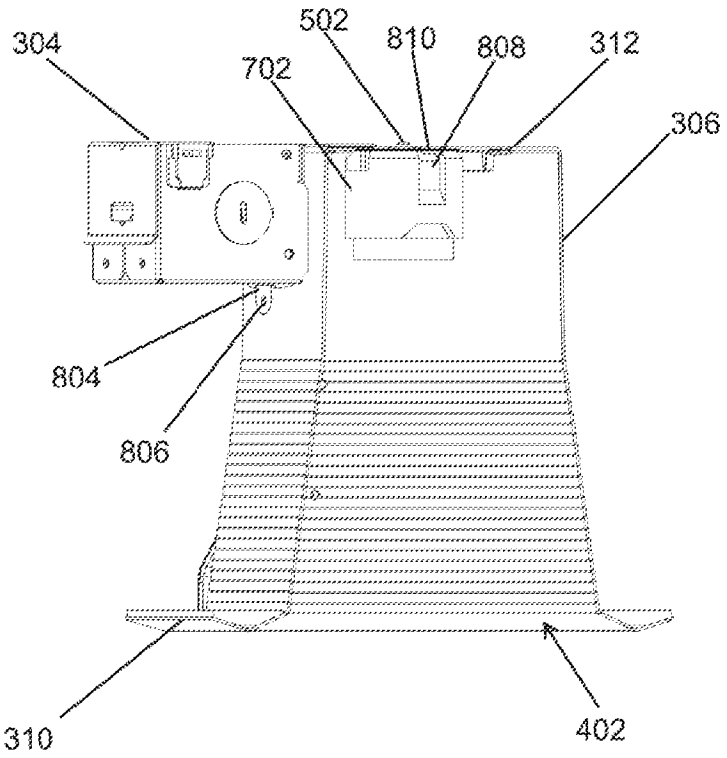
FIG. 8 illustrates a side perspective view of the recessed luminaire of FIG. 3 without a light source and with a portion of the trim removed to show inside the trim according to an example embodiment.
Figure 9:
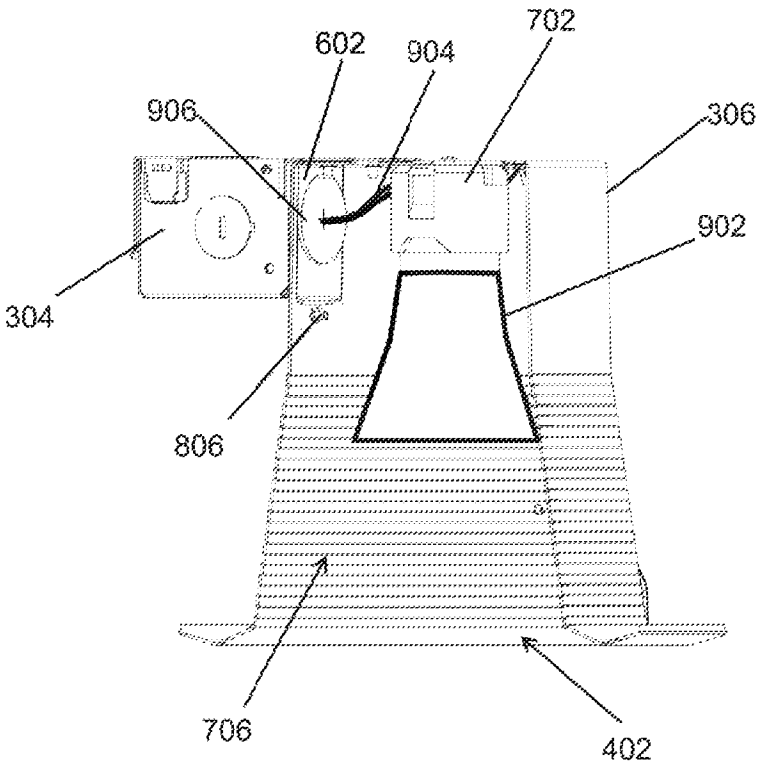
FIG. 9 illustrates a side perspective view of the recessed luminaire of FIG. 3 including a light source with a portion of the trim removed to show inside the trim according to an example embodiment.

FIG. 8 illustrates a side perspective view of the recessed luminaire 300 of FIG. 3 without a light source and with a portion of the trim 302 removed to more clearly show inside the trim 302 according to an example embodiment. FIG. 9 illustrates a side perspective view of the recessed luminaire 300 of FIG. 3 including a light source 902 with a portion of the trim 302 removed to more clearly show inside the trim 302 according to an example embodiment. Referring to FIGS. 3-9, in some example embodiments, the light source socket 702 is attached to the cover section 312 by the fastener 502. For example, the light source socket 702 may be in direct contact with the cover section 312. The locator indent 504 (more clearly shown in FIG. 7) may be positioned in a notch 808 of the socket 702, for example, to retain the socket 702 in position. A light source 902 may be removably attached to the light source socket 702 as more clearly shown in FIG. 9. The light source 902 may be an LED light source or another type of light source. The light source 902 may emit a light that exits the luminaire 300 through the opening 402, for example, to illuminate an area below the luminaire 300.

In some example embodiments, because the light source socket 702 is attached to the cover section 312 of the trim 302, heat generated by the light source 902 may be efficiently transferred to the trim 302 through the light source socket 702. When the luminaire 300 is installed recessed in a ceiling, the flange 310 of the trim 302 is generally located in a relatively cooler (e.g., room temperature) area below the ceiling, which allows for efficient dissipation of heat generated by the light source 902. The attachment of the light source socket 702 to the cover section 312 provides a heat transfer path from the light source 902 to an area below a ceiling through the cover section 312, the trim body 306, and the flange 310 for an efficient dissipation of heat generated by the light source 902.

In some example embodiments, the junction box 304 is includes an attachment tab 804 that extends down from the junction box 304 as more clearly shown in FIG. 8. For example, the attachment tab 804 may by in contact with the trim body 306. The attachment tab 804 may include an attachment hole that is aligned with the attachment hole 606 of the trim body 306. A fastener 806 may extend through the holes 804 and 606 to attach the junction box 304 to the trim 302. For example, the fastener 806 may be used in addition to or instead of the fasteners 508 (more clearly shown in FIG. 5) to attach the junction box 304 to the trim 302.

In some example embodiments, one or more electrical wires 904 may be routed between the cavity 706 of the trim 302 and the cavity of the junction box 304. The electrical wires 904 may be used to provide power to the light source 902. For example, the electrical wires 904 may be connected to other electrical wires inside the junction box 304 as can be readily understood by those of ordinary skill in the art with the benefit of the scope of this disclosure. Inside the cavity 706 of the trim 302, the electrical wires 904 may be connected to the light source socket 702 and the thermal protector 704 such that the thermal protector 704 can disconnect power to the light source socket 702, and thus to the light source 902, to reduce the risk of fire as can be readily understood by those of ordinary skill in the art with the benefit of the scope of this disclosure. For example, one or more electrical wires may be connected between the light source socket 702 and thermal protector 704.

In some example embodiments, the electrical wires 904 may be routed through a slot in a gasket 906 that is attached to the trim body 306 overlapping the wire opening 604 of the trim 302 shown in FIG. 6. For example, the gasket 906 may be attached to the trim body 306 using an adhesive. In some alternative embodiments, the gasket 906 may be omitted without departing from the scope of this disclosure.

In some alternative embodiments, some components of the luminaire 300 may be omitted without departing from the scope of this disclosure. For example, the tab 804 and the fastener 806 may be omitted without departing from the scope of this disclosure. As another example, the locator tab 504 and/or the notch 808 may be omitted without departing from the scope of this disclosure. As yet another example, the thermal protector 704 may be omitted without departing from the scope of this disclosure. In some alternative embodiments, the light source 902 may have a different shape than shown without departing from the scope of this disclosure.

Figure 10:
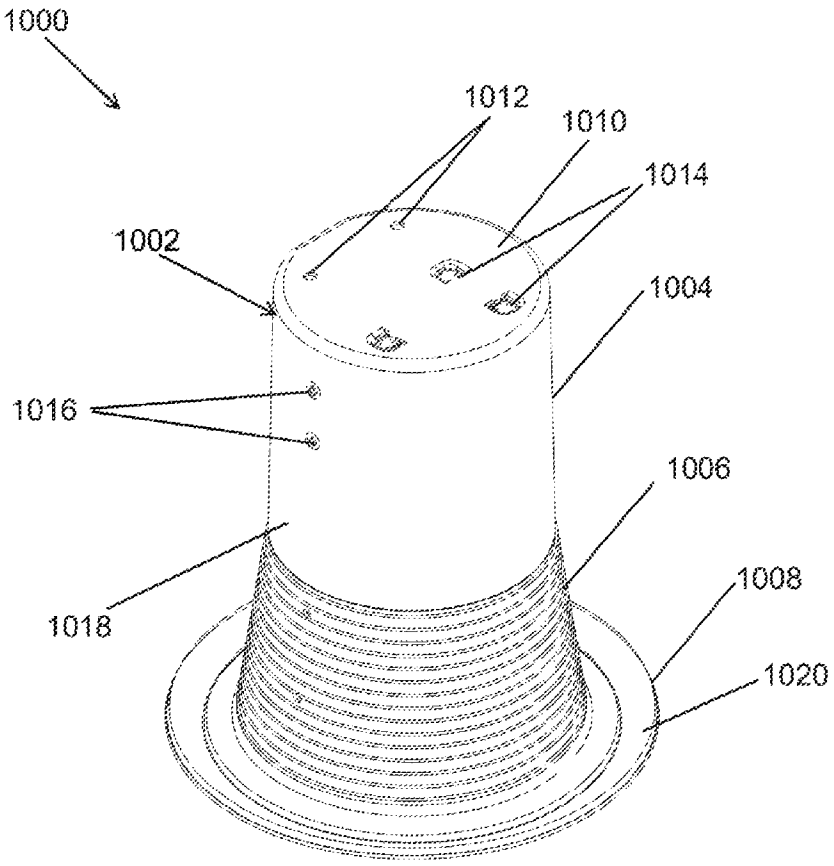
FIG. 10 illustrates a top perspective view of a recessed luminaire according to an example embodiment.
Figure 11:
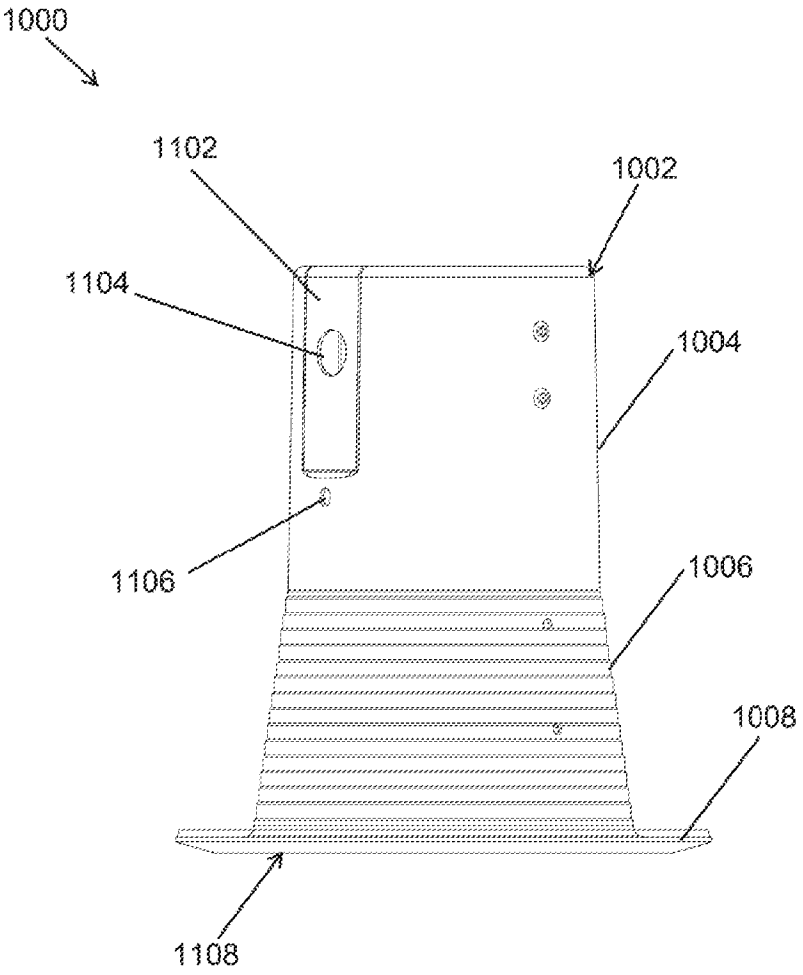
FIG. 11 illustrates a side perspective view of the recessed luminaire of FIG. 10 according to an example embodiment.

FIG. 10 illustrates a top perspective view of a recessed luminaire 1000 according to an example embodiment, and FIG. 11 illustrates a side perspective view of the recessed luminaire 100 of FIG. 10 according to an example embodiment. Referring to FIGS. 10 and 11, in some example embodiments, the luminaire 1000 includes a trim 1002. The luminaire 1000 may also include, in a cavity of the trim 1002, a light source socket, a light source removably attached to the light source socket, and a thermal protector as described below.

In general, the trim 1002 may be similar to and may have features described with respect to the trim 302 of the luminaire 300 of FIGS. 3-9. To illustrate, in some example embodiments, the trim 1002 includes a trim body 1004, a flange 1008, and a cover section 1010. The cover section 1010 of the trim 1002 encloses the cavity of the trim 1002 at an opposite end from an opening 1108 of the trim 1002. The trim body 1004 may include a baffle section 1006 and a cylindrical section 1018 that may respectfully correspond to the baffle section 308 and the cylindrical section 322 of the trim body 306 of the trim 302 shown in FIG. 3. For example, the baffle section 1006 may be tapered and may include pattern to reduce glare. As another example, the baffle section 1006 and/or the cylindrical section 1018 may serve as a reflector. The flange 1008 may extend out from the trim body 1004 at the opening 1108 of the trim 1002 in a similar manner as described with respect to the trim 302 of FIG. 3.

In some example embodiments, the luminaire 1000 may include a gasket 1020 that is positioned on the flange 1008 around the trim body 1004. The gasket 1020 may serve to prevent or reduce air flow through a gap that may exist between the flange 1008 and a ceiling when the luminaire 1000 is recessed in the ceiling, for example, through an opening in the ceiling. For example, the gasket 1020 may prevent or reduce air flow between an area (e.g., an air conditioned area) below a ceiling and an area behind the ceiling. In some alternative embodiments, the gasket 1020 may be omitted without departing from the scope of this disclosure.

In some example embodiments, the trim body 1004 may include a substantially flat section 1102 that includes a wire opening 1104. For example, a portion of a wall of a junction box, such as the junction box 304, may come in direct contact with the flat section 1102, and a wire opening of the junction box may be aligned with the wire opening 1104 for routing one or more electrical wires between the cavity of the trim 1002 and the cavity of the junction box. Alternatively, the luminaire 1000 may not include a junction box that is attached to the trim 1002, and electrical wires or a conduit carrying electrical wires may be routed through the wire opening 1104. In some example embodiments, a gasket may be used to cover the wire opening 1104 in a similar manner as described above with respect to FIG. 6.

In some example embodiments, a junction box may be attached to the trim 1002 in a similar manner as described above with respect to the luminaire 300. For example, fasteners, such as the fasteners 508 shown in FIG. 5, may be used to attach the junction box 304 to the cover section 1010 of the trim 1002 by extending the fasteners through holes 1012 in the cover section 1010 and through holes in the attachment tab 314 of the junction box 304. Alternatively, or in addition, a fastener, such as the fastener 806 shown in FIG. 8, may be used attach the junction box 304 to the trim 1002.

In some example embodiments, the cover section 1010 may include indents 1014 that are used to attach a thermal protector inside the cavity of the trim 1002 in a similar manner as described with respect to the luminaire 300. In contrast to the luminaire 300, the luminaire 1000 may include a bracket for retaining a light source inside the cavity of the trim 1002 as described below. For example, the bracket may be attached to the trim body 1004 by fasteners such as fasteners 1016.

In some example embodiments, the trim 1002 may be made from aluminum or another suitable material in a similar manner as described with respect to the trim 302 of the luminaire 300 of FIG. 3. In some alternative embodiments, the trim 1002 may be painted or otherwise coated as described with respect to the trim 302 of the luminaire 300 of FIG. 3.

In general, the luminaire 1000 offers the same or similar benefits described above with respect to the luminaires 100 and 300. For example, the luminaire 1000 may require less installation effort and time than luminaires that include a luminaire housing. The luminaire 1000 also enables a consumer to alter the lighting provided by the luminaire 1000 by allowing the light source of the luminaire 1000 to be changeable by the consumer.

In some alternative embodiments, the trim 1002 or sections of the trim 1002 may have a different shape than shown without departing from the scope of this disclosure. In some alternative embodiments, the baffle section 1006 may not be tapered without departing from the scope of this disclosure. In some example embodiments, the relative sizes of the baffle section 1006 and the cylindrical section 1018 may be different than shown without departing from the scope of this disclosure. In some alternative embodiments, the luminaire 1000 may include the retaining structures 316, 318 shown in FIG. 3 or other retaining structures without departing from the scope of this disclosure.

Figure 12:
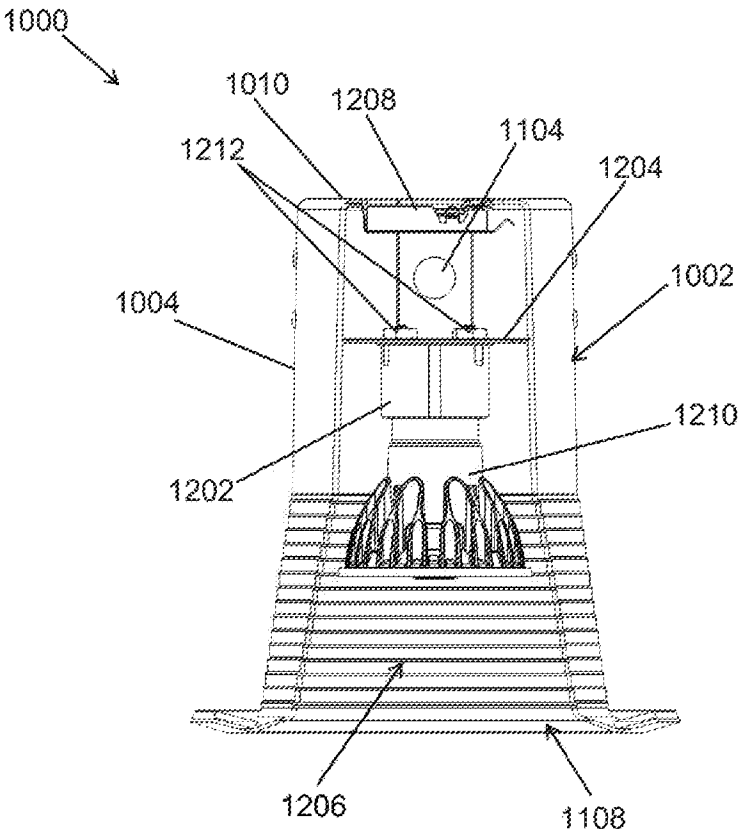
FIG. 12 illustrates a side perspective view of the recessed luminaire of FIG. 10 with a portion of the trim removed to show inside the trim according to an example embodiment.
Figure 13:
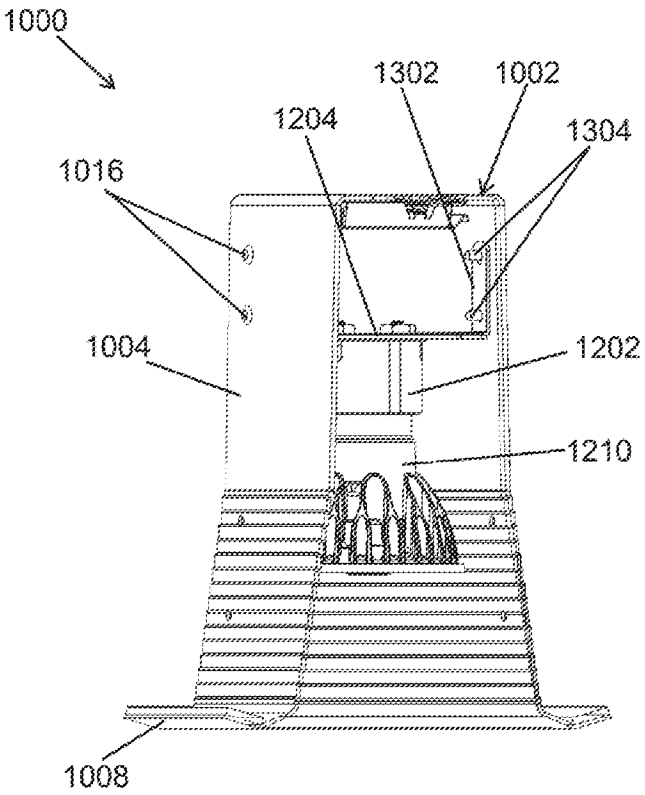
FIG. 13 illustrates another side perspective view of the recessed luminaire of FIG. 10 with a portion of the trim removed to show inside the trim according to an example embodiment.
Figure 14:
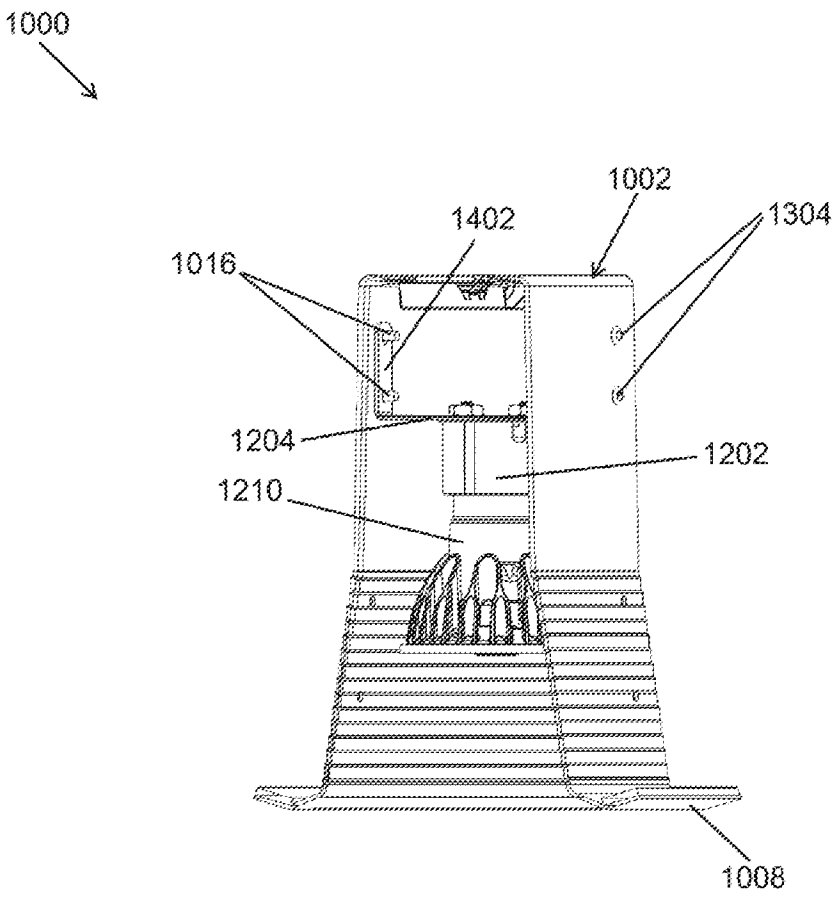
FIG. 14 illustrates another side perspective view of the recessed luminaire of FIG. 10 with a portion of the trim removed to show inside the trim according to an example embodiment.

FIG. 12 illustrates a side perspective view of the recessed luminaire 1000 of FIG. 10 with a portion of the trim 1002 removed to show inside the trim 1002 according to an example embodiment. FIG. 13 illustrates another side perspective view of the recessed luminaire 1000 of FIG. 10 with a portion of the trim 1002 removed to show inside the trim 1002 according to an example embodiment. FIG. 14 illustrates another side perspective view of the recessed luminaire 1000 of FIG. 10 with a portion of the trim 1002 removed to show inside the trim 1002 according to an example embodiment. Referring to FIGS. 10-14, in some example embodiments, the luminaire 1000 includes a light source socket 1202 that is attached to a bracket 1204 inside a cavity 1206 of the trim 1002. The luminaire 1000 may also include a light source 1210 that is removably attached to the light source socket 1202. The light source 1210 may emit light through the opening 1108 of the trim 1002, for example, to illuminate an area below a ceiling.

In some example embodiments, the luminaire 1000 may also include a thermal protector 1208 in the cavity 1206 of the trim 1002. The thermal protector 1208 may be attached to the cover section 1010 in a similar manner as described above with respect to the thermal protector of the luminaire 300. Alternatively, the thermal protector 1208 may be positioned in the cavity 1206 of trim 1002 attached to another part of the trim 1002 without departing from the scope of this disclosure.

In some example embodiments, the light source socket 1202 may be attached to the bracket 1204 by one or more fasteners 1212 (e.g., screws), and the bracket 1204 may be attached to the trim 1002 using fasteners 1016 and 1304 that are more clearly shown in FIGS. 13 and 14. The bracket 1204 may include attachment sections 1302 and 1402 that are at opposite sides of the light source socket 1202 from each other. For example, the fasteners 1304 may extend through holes in the attachment section 1302 to attach the bracket 1204 to the trim body 1004, and the fasteners 1016 may extend through holes in the attachment section 1402 to attach the bracket 1204 to the trim body 1004.

In some example embodiments, the attachment sections 1302, 1402 may be in contact with the trim body 1004 such that heat generated by the light source 1210 may be efficiently transferred to the flange 1008 through the trim body 1004, the light source socket 1202 and the bracket 1204. Because the flange 1008 may be positioned below a ceiling in an area with a relatively cooler temperature, heat generated by the light source 1210 may be efficiently dissipated.

In some example embodiments, the light source 1210 may be a similar type of light source used in the luminaires 100 and 300. In some alternative embodiments, the bracket 1204 may be attached to the trim 1002 using fewer or more fasteners than shown without departing from the scope of this disclosure. In some alternative embodiments, some components of the luminaire 1000 may have a different shape than shown without departing from the scope of this disclosure. For example, the bracket 1204 may have a different shape than shown without departing from the scope of this disclosure. In some alternative embodiments, different types of fasteners than shown may be used in the luminaire 1000 without departing from the scope of this disclosure. In some alternative embodiments, some components of the luminaire 1000 may be omitted without departing from the scope of this disclosure. For example, the thermal protector 1208 may be omitted without departing from the scope of this disclosure. In some alternative embodiments, the light source 1210 may extend partially out of the cavity 1206 of the trim 1002.

Figure 15:
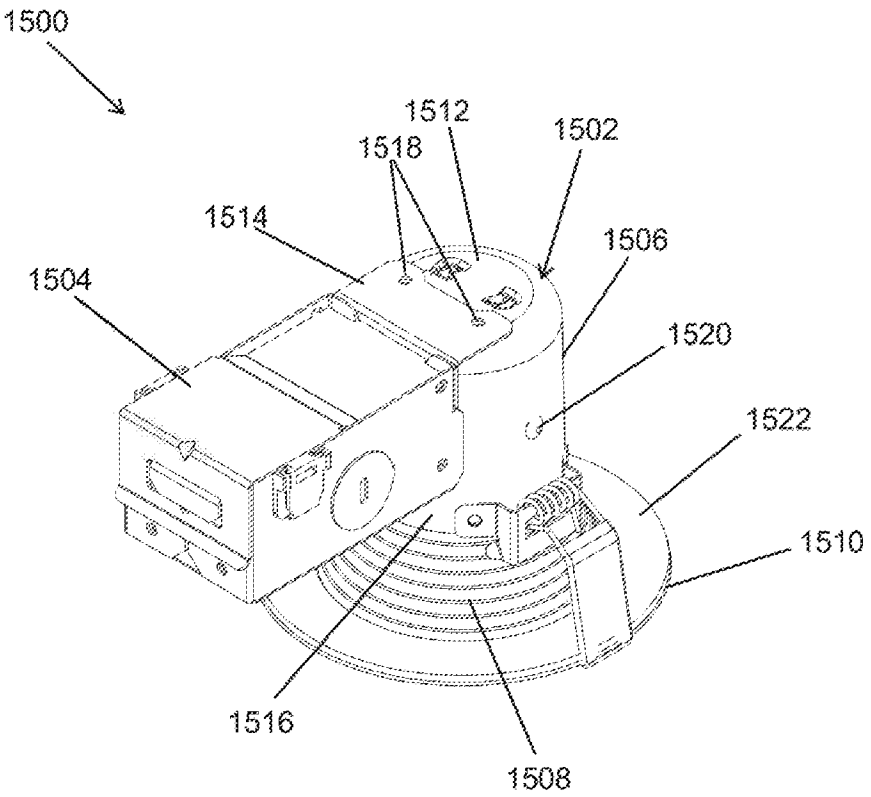
FIG. 15 illustrates a perspective view of a recessed luminaire according to an example embodiment.
Figure 16:
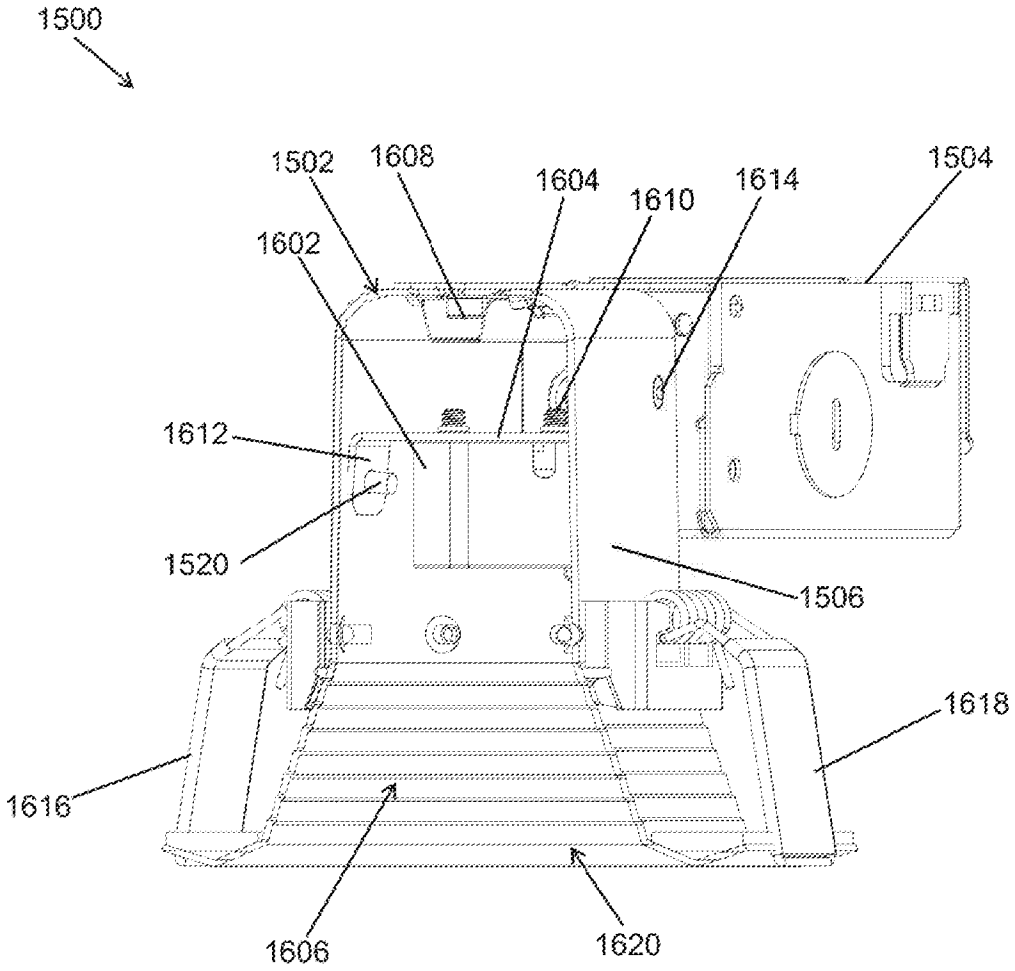
FIG. 16 illustrates another side perspective view of the recessed luminaire of FIG. 15 with a portion of the trim removed to show inside the trim according to an example embodiment.
Figure 17:
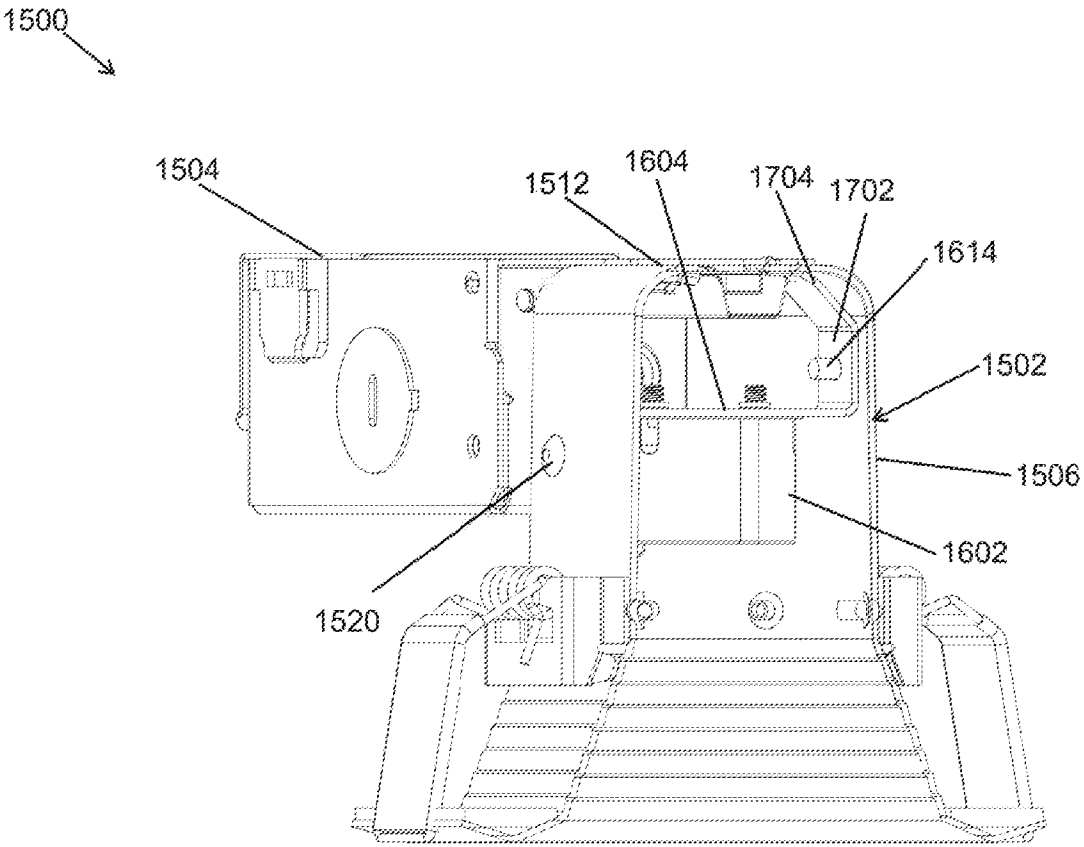
FIG. 17 illustrates another side perspective view of the recessed luminaire of FIG. 15 with a portion of the trim removed to show inside the trim according to an example embodiment.

FIG. 15 illustrates a perspective view of a recessed luminaire 1500 according to an example embodiment. FIG. 16 illustrates another side perspective view of the recessed luminaire 1500 of FIG. 15 with a portion of the trim 1502 removed to show inside the trim 1502 according to an example embodiment. FIG. 17 illustrates another side perspective view of the recessed luminaire 1500 of FIG. 15 with a portion of the trim 1502 removed to show inside the trim 1502 according to an example embodiment. Referring to FIGS. 15-17, in general, the luminaire 1500 is similar to the luminaire 300 and the luminaire 1000. For example, the trim 1502 may be similar to and may have features described with respect to the trim 302 of the luminaire 300 of FIG. 3.

In some example embodiments, the luminaire 1500 includes a trim 1502 and a junction box 1504. The trim 1502 may include a trim body 1506, a flange 1510, and a cover section 1512. The trim body 1506 may include a baffle section 1508 and a cylindrical section 1516. In some example embodiments, the baffle section 1508 and the cylindrical section 1516 may be similar to the baffle section and the cylindrical section of the trim body of other luminaires described herein. For example, the baffle section 1508 and the cylindrical section 1516 may respectfully correspond to the baffle section 308 and the cylindrical section 322 of the trim body 306 of the trim 302 shown in FIG. 3. The cover section 1512 encloses a cavity 1606 of the trim 1502 at an opposite end from an opening 1620 of the trim 1502. The flange 1510 may extend outwardly from the trim body 1506 at the opening 1620 of the trim 1502. The trim 1502 may be made using the same type(s) of material and/or method as described with respect to the luminaires 100, 300, and 1000.

In some example embodiments, the luminaire 1500 may include a gasket 1522 that is positioned on the flange 1510 around the trim body 1506. The gasket 1522 may serve to prevent or reduce air flow through a gap that may exist between the flange 1510 and the ceiling. For example, the gasket 1522 may prevent or reduce air flow between an area (e.g., an air conditioned area) below a ceiling and an area behind the ceiling. In some alternative embodiments, the gasket 1522 may be omitted without departing from the scope of this disclosure.

In some example embodiments, the junction box 1504 may correspond to the junction box 304 and may be attached to the trim 1502 in a similar manner as described with respect to the luminaire 300. For example, one or more fasteners 1518 may be used to attach an attachment section 1514 of the junction box 1504 to the cover section 1512 of the trim 1502.

In some example embodiments, the luminaire 1500 may include a light source socket 1602 and a bracket 1604. A light source, such as the light source of the luminaires 100, 300, 1000, may be removably attached to the light source socket 1602. The light source socket 1602 may be attached to the bracket 1604 using one or more fasteners 1610. For example, the light source socket 1602 may be in direct contact with the bracket 1604. The bracket 1604 may include attachment sections 1612 and 1702 that are on different sides of the socket 1602 from each other. A fastener 1520 may extend through corresponding holes in the trim body 1506 and the attachment section 1612 to attach the bracket 1604 to the trim 1502, and a fastener 1614 may extend through corresponding holes in the trim body 1506 and the attachment section 1702 to attach the bracket 1604 to the trim 1502. For example, the attachment sections 1612, 1702 may be in contact with the trim body 1506 such that heat can efficiently transfer from the bracket 1604 to the trim body 1506. That is, heat generated by a light source attached to the light source socket 1602 may be efficiently transferred to the flange 1510 via the light source socket 1602, the bracket 1604, the trim body 1506. The bracket 1604 may also include a tab 1704 that extends from an end of the attachment section 1702. The tab 1704 may be bent relative to the attachment section 1702 and may be in contact with the cover section 1512 inside the cavity 1606. The tab 1704 may serve as a guide to stop the insertion of the bracket 1604 in the cavity 1606 during the attachment of the bracket 1604 to the trim body 1506.

In some example embodiments, the luminaire 1000 may include a thermal protector 1608 in the cavity 1606 of the trim 1502. The thermal protector 1608 may be attached to the cover section 1512 in a similar manner as described above with respect to the thermal protector of the luminaire 300. Alternatively, the thermal protector 1608 may be attached to another part of the luminaire 1500 without departing from the scope of this disclosure. The thermal protector 1608 operates to disconnect power to the light source socket 1602, and thus, to a light source attached to the light source socket 1602, to reduce fire risk as can be readily understood by those of ordinary skill in the art with the benefit of the scope of this disclosure. Electrical wires may be routed between the junction box 1504 and the cavity 1606 of the trim 1502 to provide power to a light source attached to the light source socket 1602 in a similar manner as described with respect to the luminaire 300.

In some example embodiments, the luminaire 1500 may include retaining structures 1616, 1618 that are used to retain the luminaire 1500 recessed in a ceiling in a similar manner as the retaining structures 316, 318 described above to retain the luminaire 300. In some alternative embodiments, other types of retaining structures may be used without departing from the scope of this disclosure.

In general, the luminaire 1500 offers the same or similar benefits described above with respect to the luminaires 100, 300, 1000. For example, the luminaire 1500 may require less installation effort and time than luminaires that include a luminaire housing. The luminaire 1500 also enables a consumer to alter the lighting provided by the luminaire 1500 by allowing the light source of the luminaire 1500 to be changeable by the consumer.

In some alternative embodiments, the bracket 1604 may be attached to the trim 1502 using more fasteners than shown without departing from the scope of this disclosure. In some alternative embodiments, some components of the luminaire 1500 may have a different shape than shown without departing from the scope of this disclosure. For example, the bracket 1604 may have a different shape than shown without departing from the scope of this disclosure. In some alternative embodiments, different types of fasteners than shown may be used in the luminaire 1500 without departing from the scope of this disclosure.

In certain example embodiments, the example luminaires described herein may be subject to meeting certain standards and/or requirements. For example, the National Electric Code (NEC), the National Electrical Manufacturers Association (NEMA), the International Electrotechnical Commission (IEC), the Federal Communication Commission (FCC), and the Institute of Electrical and Electronics Engineers (IEEE) set standards as to electrical enclosures (e.g., light fixtures), wiring, and electrical connections. As another example, Underwriters Laboratories (UL) sets various standards for light fixtures. Use of example embodiments described herein meet (and/or allow a corresponding device to meet) such standards when required.

Referring generally to the foregoing examples, any luminaire components (e.g., the trim), described herein can be made from a single piece (e.g., as from a mold, injection mold, die cast, 3-D printing process, extrusion process, stamping process, or other prototype methods). In addition, or in the alternative, a luminaire (or components thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

A fastener or attachment feature (including a complementary attachment feature) as described herein can allow one or more components and/or portions of an example luminaire to become coupled, directly or indirectly, to another portion or other component of a luminaire. An attachment feature can include, but is not limited to, a flange, a snap, hook-and-loop fasteners, a clamp, a portion of a hinge, an aperture, a recessed area, a protrusion, a slot, a spring clip, a tab, a detent, and mating threads. A component can be coupled to a luminaire by the direct use of one or more attachment features.

In addition, or in the alternative, a portion of a luminaire can be coupled using one or more independent devices that interact with one or more attachment features disposed on the light fixture or a component of the light fixture. Examples of such devices can include, but are not limited to, a pin, a hinge, a fastening device (e.g., a bolt, a screw, a rivet), epoxy, glue, adhesive, tape, and a spring. One attachment feature described herein can be the same as, or different than, one or more other attachment features described herein. A complementary attachment feature (also sometimes called a corresponding attachment feature) as described herein can be a coupling feature that mechanically couples, directly or indirectly, with another coupling feature.

Terms such as "first", "second", "top", "bottom", "side", "distal", "proximal", and "within" are used merely to distinguish one component (or part of a component or state of a component) from another. Such terms are not meant to denote a preference or a particular orientation, and such terms are not meant to limit the embodiments described herein. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Although particular embodiments have been described herein in detail, the descriptions are by way of example. The features of the example embodiments described herein are representative and, in alternative embodiments, certain features, elements, and/or steps may be added or omitted. Additionally, modifications to aspects of the example embodiments described herein may be made by those skilled in the art without departing from the scope of the following claims, the scope of which are to be accorded the broadest interpretation so as to encompass modifications and equivalent structures.

What is claimed is:

1. A recessed luminaire, comprising:

a trim comprising a trim body, a flange, and a cover section, wherein the flange extends out from the trim body at an opening of the trim and wherein the trim body and the flange are formed as a single integrated component, wherein when the trim is installed in a ceiling, the flange extends outwardly below a ceiling surface and remains visible from below the ceiling surface, wherein the cover section is opposite the opening, and wherein a sidewall of the trim body is located above the opening and below the cover section and wherein the trim body and cover section form a cavity of the trim;

a junction box attached to the trim and located adjacent the sidewall of the trim body outside the cavity of the trim, wherein the junction box includes a first wire routing opening located below the cover section, and wherein a second wire routing opening is formed in a substantially flat portion of the sidewall of the trim body located below the cover section, wherein the first wire routing opening and the second wire routing opening are aligned such that a wire routed between the first wire routing opening and the second wire routing opening is routed below the cover section; and a light source socket, wherein the light source socket is attached to the trim, and wherein the light source socket is positioned inside the cavity of the trim.

2. The recessed luminaire of claim 1, further comprising a thermal protector positioned in the cavity of the trim to disconnect electrical power from the light source socket when a temperature in the cavity of the trim exceeds a threshold temperature.

3. The recessed luminaire of claim 1, wherein the cover section includes at least one guide for the attachment of the junction box to the trim.

4. The recessed luminaire of claim 1, wherein the trim body comprises a cylindrical section and a baffle section and wherein the baffle section extends down outwardly from the cylindrical section.

5. The recessed luminaire of claim 4, wherein the flange extends out from the baffle section.

6. The recessed luminaire of claim 4, wherein the junction box is attached to the cover section and to the cylindrical section.

7. The recessed luminaire of claim 4, wherein the junction box is directly attached to the cylindrical section.

8. The recessed luminaire of claim 1, wherein a heat shield material is located between the light source socket and the cover section.

9. The recessed luminaire of claim 1, further comprising a bracket positioned in the cavity of the trim and attached to the trim, wherein the light source socket is attached to the bracket.

10. The recessed luminaire of claim 1, wherein the cavity of the trim does not mechanically attach additional trims.

11. A recessed luminaire, comprising:

a trim comprising a trim body, a flange, and a cover section, wherein the flange extends out from the trim body at an opening of the trim and wherein the trim body and the flange are formed as a single integrated component, wherein when the trim is installed in a ceiling, the flange extends outwardly below a ceiling surface and remains visible from below the ceiling surface, wherein a sidewall of the trim body is located above the opening and below the cover section and wherein the trim body and cover section form a cavity of the trim;

a junction box attached to the trim and located adjacent the sidewall of the trim body outside the cavity of the trim with a first wire routing opening located below the cover section, wherein a second wire routing opening is formed in a substantially flat portion of a sidewall of the trim body located below the cover section, wherein the first wire routing opening and the second wire routing opening are aligned such that a wire routed between the cavity of the trim and a cavity of the junction box is routed below the cover section; and a light source socket, wherein the light source socket is attached to the trim, and wherein light source socket is positioned inside the cavity of the trim.

12. The recessed luminaire of claim 11, further comprising a thermal protector positioned in the cavity of the trim to disconnect electrical power from the light source socket when a temperature in the cavity of the trim exceeds a threshold temperature.

13. The recessed luminaire of claim 11, wherein the cover section encloses the cavity of the trim at an end of the trim opposite from the opening of the trim, and wherein an attachment tab extends from the junction box and is attached to the cover section.

14. The recessed luminaire of claim 11, wherein the trim body comprises a cylindrical section and a baffle section, and wherein the baffle section extends down outwardly from the cylindrical section.

15. The recessed luminaire of claim 11, wherein the light source socket is directly attached to the cover section.

16. The recessed luminaire of claim 11, further comprising a bracket positioned in the cavity of the trim and attached to the trim, wherein the light source socket is attached to the bracket.

17. A recessed luminaire, comprising:

a trim comprising a body, a flange, a trim cap, and a light emitting opening, wherein the body and the flange are formed as a single integrated component, wherein when the trim is installed in a ceiling, the flange extends outwardly below a ceiling surface and remains visible from below the ceiling surface, and wherein the trim cap encloses the body at an end of the trim opposite from the light emitting opening, wherein a sidewall of the body is located above the opening and below the trim cap and wherein the body and trim cap form a cavity of the trim;

one or more retention devices coupled to an outer surface of the trim;

a light source socket disposed on an inner surface of the trim;

a first aperture in a substantially flat portion of the sidewall below the trim cap; and a conduit comprising a first end and a second end, the first end adapted to couple to the first aperture located below the trim cap and the second end adapted to couple to a second aperture in a junction box, wherein the conduit routes a wire between a cavity of the trim and a cavity of the junction box such that the wire routed between the cavity of the trim and a cavity of the junction box is routed below the trim cap, and wherein substantially all of the cavity of the junction box is located below the trim cap and outside of the body.

18. The recessed luminaire of claim 17, wherein the light source socket is configured to receive a light emitting diode light source or a compact fluorescent light source.

19. The recessed luminaire of claim 17, further comprising a thermal protector directly attached to the trim cover and a bracket positioned in the cavity of the trim and attached to the trim, wherein the light source socket is attached to the bracket and located entirely below the thermal protector.

20. The recessed luminaire of claim 17, wherein the body is separated from the junction box by the conduit.

* * * * *